US005915389A

United States Patent [19]

Tang

[11] Patent Number: 5,915,389

[45] Date of Patent: Jun. 29, 1999

[54] APPARATUS AND METHODS FOR FASTENING A HAIRPIECE

[76] Inventor: Gordon Tang, 13 Diamond "S" Ranch, Bellevue, Wash. 98004

[21] Appl. No.: 08/996,387

[22] Filed: Dec. 22, 1997

[51] Int. Cl.[6] ..... A41G 5/00

[52] U.S. Cl. ..... 132/53; 2/174

[58] Field of Search ..... 132/53, 201, 54, 132/55; 623/10; 2/174, 209, 209.14

[56] References Cited

U.S. PATENT DOCUMENTS

| | | | |
|---|---|---|---|
| 520,785 | 6/1894 | Jung | 2/209 |
| 1,558,931 | 10/1925 | Senegas | 132/54 |
| 2,040,246 | 5/1936 | Donoher . | |
| 2,198,546 | 4/1940 | Lover et al. | 2/174 |
| 3,249,949 | 5/1966 | Rosenberg et al. | 2/209 |
| 3,651,820 | 3/1972 | Johnson et al. . | |
| 3,654,935 | 4/1972 | Brown . | |
| 3,970,092 | 7/1976 | Nelson . | |
| 4,168,713 | 9/1979 | Agiotis . | |
| 4,176,669 | 12/1979 | Levin . | |
| 5,033,486 | 7/1991 | Finamore et al. . | |
| 5,117,846 | 6/1992 | Finamore et al. . | |
| 5,357,986 | 10/1994 | Hargrett . | |

FOREIGN PATENT DOCUMENTS

| | | | |
|---|---|---|---|
| 8403597 | 7/1985 | Netherlands | 132/53 |
| 481957 | 6/1936 | United Kingdom | 132/54 |

*Primary Examiner*—Todd E. Manahan
*Assistant Examiner*—Eduardo C. Robert
*Attorney, Agent, or Firm*—Vance, Romero & Montague, P.S.

[57] ABSTRACT

Apparatus for attaching a hairpiece to an ear and head of a wearer uses an engaging device that grips and clips a portion of the ear of the wearer. The apparatus attaches the hairpiece without having to pierce the scalp of the wearer or use adhesive when the apparatus is worn. The apparatus also has a securing part which secures the ear engaging device to the hairpiece.

14 Claims, 7 Drawing Sheets

APPARATUS AND METHODS FOR FASTENING A HAIRPIECE

COPYRIGHT NOTICE

© Copyright 1997, James R. Vance. All Rights Reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to apparatus and methods for fastening or attaching a hairpiece, such as a toupee or a wig, to an ear and head of a wearer.

BACKGROUND ART

Since the introduction of artificial hairpieces, toupees and wigs were generally held in place by either using hair pins to attach the hairpiece to the remaining natural hair of the wearer or causing there to be a tight frictional fit between the scalp of the wearer and the underside of the worn hairpiece.

Alternatively, one or more strips of double-sided adhesive tape were applied to the underside of the hairpiece. The exposed, lower side or surface of the adhesive tape which was secured to the hairpiece was then urged against the scalp of the person to secure the hairpiece in place. Thus positioned, the hairpiece was held in place by the adhesive forces associated with the double-sided adhesive tape.

Another means heretofore used to attach a hairpiece to the head of a wearer required that a plurality of pins or posts be surgically secured or attached to the skull of the wearer. Such securement or attachment generally required that the scalp of the wearer be pierced, a plurality of holes be drilled into the skull of the wearer, and threaded pins or posts be forced and rotated into the drilled holes.

Each pin or post extended outwardly from a mechanically attached portion located within the wearer's skull, through a hole drilled within the scalp or skin of the wearer, to an exposed and accessible portion. In other words, the pins or posts extended through and past the skin of the wearer's scalp. The hairpiece was then mechanically secured to the outwardly projecting, terminal end of the pins or posts by the use of snaps.

Surgical placement of the implanted pins or posts into the skull of the person is a dangerous, painful and expensive operation. The skin surrounding the pins or posts usually does not heal properly. Infections of the scalp are very common. When a hairpiece is not worn, the appearance of the person wearing such pins or posts is not very attractive. Pressures urged against the pins or posts, such as imparted by a pillow when sleeping or from making unintentional contact with other objects, are not only uncomfortable, but place undue leverage against the pins or posts and increase the possibility that the skull might fracture about the base of the pins or posts. Furthermore, the effects of heat and cold are quickly transmitted through the metallic pins or posts into the scalp and skull of the wearer.

In summary, procedures using such surgical implantation significantly sacrifice the comfort and safety of the patient or wearer in an attempt to obtain some, albeit misplaced, confidence that the hairpiece would not be inadvertently removed.

In an effort to provide alternative means for securing a hairpiece to the head of a person, a wide variety of different devices have been invented. For example, the following patents illustrate various hairpiece holding structures: Donoher (U.S. Pat. No. 2,040,246; issued May 12, 1936); Johnson et al. (U.S. Pat. No. 3,651,820; issued Mar. 28, 1972); Brown (U.S. Pat. No. 3,654,935; issued Apr. 11, 1972); Nelson (U.S. Pat. No. 3,970,092; issued Jul. 20, 1976); Agiotis (U.S. Pat. No. 4,168,713; issued Sep. 25, 1979); Levin (U.S. Pat. No. 4,176,669; issued Dec. 4, 1979); Finamore et al. (U.S. Pat. No. 5,033,486; issued Jul. 23, 1991); Finamore et al. (U.S. Pat. No. 5,117,846; issued Jun. 2, 1992); and Hargrett (U.S. Pat. No. 5,357,986; issued Oct. 25, 1994).

Use of the devices identified above often presents several significant problems. For example, many of such devices are very expensive to design, engineer, manufacture, mass produce, and mass distribute. In many cases, the persons who need such devices the most often are the least able to afford them. This is particularly true in the case of elderly persons and senior citizens who may have a restricted source of income.

The effectiveness of such devices is less than desired.

Such devices are usually very uncomfortable to wear. For example, the adhesive material is usually urged directly against the scalp of the wearer and does not generally permit breathing of the adjacent skin. Consequently, when the wearer's scalp perspires or is rained upon, a moist and damp environment is created between the scalp of the wearer and the hairpiece. The feelings of dampness, moisture and sweating are very distracting and uncomfortable for the wearer. Furthermore, the adhesive forces between the adhesive material and the scalp are greatly reduced in such a damp environment, often causing the device to fail. Under such circumstances, the wearer would feel very insecure about the reliability of using such adhesive material.

If the patient frequently replaces the device in order to avoid the unpleasant feeling of moisture and dampness, the wearer must purchase, stock and replenish a vast number of replacement devices. Due to the exorbitant price of such devices, frequent replacement of the devices can be extremely expensive, inconvenient, and time consuming.

If the device is not frequently replaced, the capacity of the adhesive strips to hold the hairpiece in place may be exceeded. The result, much to the dismay and embarrassment of the wearer, is failure of the device to properly retain the hairpiece in position.

When the adhesive strips are adhered to the wearer's scalp for prolonged periods of time, various skin diseases and chaffing of the skin and/or scalp of the wearer often results.

Another notable disadvantage is the dramatically limited application of the above-mentioned devices to different scalp conditions. In other words, the devices are designed to only function in particular scalp and hair conditions. For example, a double sided adhesive strip would not work well when hair of the wearer is only thinning and a sufficient amount of scalp is unavailable for adequate adhesion. Conversely, if the wearer's scalp is completely bald, devices that utilize interlacing of the wearer's hair through a mesh material to hold the hairpiece in place cannot be effectively used. The structural requirements and limitations of such hairpiece holding devices significantly limit the actual market for those devices.

The inventor believes that the above-cited devices and patents, whether taken alone or in combination, neither anticipate nor render obvious the current invention. The foregoing explanation and citations do not constitute an admission that such devices or patents are relevant or material to the appended patent claims. Rather, such devices and patents relate only to the general field of the current invention.

DISCLOSURE OF INVENTION

The apparatus and methods of this invention may be used by any person, young or old, male or female, who suffers from hair loss and/or hair thinning, and desires to wear a hairpiece, such as a toupee or a wig. For example, this invention may be used by persons undergoing chemotherapy which has resulted in the loss of their hair. This invention could similarly be used by persons who through aging or genetic heredity have lost or are losing the hair on their head.

In essence, this invention may be used by any person or patient who could benefit from the simple, reliable, easily used apparatus and methods that this invention provides. The apparatus of this invention is easily constructed and is inexpensive and economical to manufacture. The apparatus of this invention compact, unobtrusive, easily concealed, efficient, durable, rugged, reliable, reusable, washable, and is extremely simple to assemble and use. Only a minimum amount of manipulation, physical dexterity and effort are required to apply and/or remove the apparatus.

The apparatus and methods taught herein enable a person to quickly, effectively, and safely fasten and/or attach a hairpiece to one or more of their ears and thereby to their head, without requiring the application of adhesive strips to the wearer's scalp or requiring the wearer to undergo painful surgery. Within many embodiments of this invention, the apparatus can be worn without any invasive surgery or piercing of the wearer's skin.

The apparatus of this invention is relatively comfortable to wear, which constitutes a dramatic increase in comfort when compared to the prior known devices.

The complexity of the apparatus is greatly reduced, as compared to the complexity of the prior known devices.

This invention may be used to minimize the inconvenience, embarrassment and self-conscious paranoia that a person suffering from hair loss or hair thinning might experience. More specifically, an important and particularly beneficial feature of this invention is the small size of its apparatus. The size and bulkiness of the apparatus are very much minimized. The small size and lack of thickness of the apparatus enables the wearer to avoid drawing undesired attention to the invention and hairpiece. In other words, this invention may be worn without drawing undue attention thereto. The apparatus of the current invention may assume the general overall appearance of an ear clip, ear ring, hearing aide, or the like. Furthermore, this invention permits the wearer to easily hide and/or obscure the small apparatus with his or her natural hair, or with an accessory such as a scarf, hat, headband, earring, and the like.

It is the intention of the inventor that persons using the current invention will experience a significant increase in their level of confidence, and will lead more product lives during its use. For example, the current invention not only increases the speed and simplifies the procedure to secure or attach a hairpiece to the head of a wearer, it also provides means for protecting oneself against the embarrassment of having the hairpiece become dislodged during use or be blown off when subjected to wind forces. Consequently, freedom of movement is increased without endangering the placement and/or retention of the hairpiece. The wearer of the current invention may now concentrate upon other activities without having to constantly worry about the condition and position of the hairpiece and holding apparatus.

The inventor intends that the prosthesis or ear engaging means be manufactured from a very thin, nonreflective, transparent material, such as a thin piece of plastic. Alternatively, the prosthesis may be manufactured from translucent or opaque materials that are colored to match or contrast with the skin tone of the wearer.

To minimize the size and dramatically increase comfort for the wearer, the prosthesis or ear engaging means may comprise an apparatus, appliance or device that is custom-fitted or form-fitted to the individual shape of the wearer's ear. Such specially and specifically form-fitted apparatus could be manufactured on site and be immediately distributed to a patient by medical doctors, plastic surgeons, special medical clinics, hospitals, and the like.

For example, the apparatus could be soaked in hot water or otherwise heated until it becomes malleable or bendable. The apparatus could then be bent, shaped, or molded to conform to the contours or comfort level of the wearer. A doctor, technician and/or the wearer could accomplish this molding procedure.

The apparatus may be easily adjusted or modified to provide a wide variety of different sizes and thereby accommodate the needs of a larger consumer base. Such adjustment or modification can be accomplished with a minimum amount of delay or difficulty. Depending upon which embodiment of the invention is used, the size of the bands, cords, or straps may be easily adjusted.

Alternatively, a more generally fitted apparatus, appliance or device, which defines the ear engaging means, could be manufactured for mass distribution and use. In other words, if standardized sizes and shapes are used, this invention could be mass produced and commercially distributed. Thus manufactured, this invention could be readily purchased for general consumer use at nearly every hospital, medical clinic, nursing home, pharmacy, drug store, hair salon, wig shop, toupee shop, and small or large retail department store throughout the country and abroad.

Since this invention can be used by a large consumer base, such mass produced apparatus can be manufactured and distributed at very competitive prices. Persons suffering from hair loss no longer need to pay exorbitant fees, purchase specially ordered apparatus from medical supply companies, or undergo painful and expensive surgery to accommodate their needs.

Furthermore, the teachings of this disclosure can be used to manufacture a wide variety of differently structured apparatus, attachments, mechanisms, systems, and securement means to fasten and attach a hairpiece to the head of a wearer. Consequently, this invention can be used to accommodate the needs of a vast number of persons having different and varied body sizes and lifestyles.

The potential consumer base for this invention is significantly broader than what would otherwise be available for the heretofore known devices. The scope and versatility of this invention are also very much broader than the previously known devices.

Traditional and/or nontraditional manufacturing apparatus and procedures may be used to manufacture the current invention without requiring significant alteration thereto to accomplish the purposes taught herein.

Once manufactured, the apparatus of the current invention can be easily transported, stored, and worn using a minimum amount of space. Consequently, the invention minimizes the packaging size and cargo space required to contain and ship the apparatus. This in turn, reduces transportation and storage costs.

To achieve these general and specific objectives, the apparatus of the current invention generally comprises the combination of: (a) means for selectively and removably engaging the ear of the wearer; and (b) means for securing the ear engaging means to a hairpiece. The ear engaging means selectively and removably grips at least a portion of the ear. The securing means is attached to or formed integrally with the ear engaging means. In turn, the hairpiece is secured or attached to the securing means.

To obtain a general understanding of the intent of the current invention, imagine a hairpiece comprising a full wig. The wig is pulled down over the scalp and close to and/or over the ears of the wearer. Now imagine the wearer using a hearing aid that is placed within the auditory canal of the wearer. The hearing aid is retained in its position by it being molded or formed to the general shape of the auditory canal of the wearer. The hearing aid is then provided with means for attaching the hairpiece thereto. For example, each hearing aid could be provided with a post or a snap that operatively mates with a corresponding snap or post appropriately positioned on or near the lower periphery of the hairpiece.

During use, the wig is simply placed upon the head of the wearer, the hearing aid is placed within the auditory canal of the wearer, and the wig is connected to the hearing aid. The engagement of the hearing aid within the auditory canals of the wearer's ears lends support to maintaining the position of the hairpiece upon the head of the wearer.

In many circumstances, however, the wearer does not need to wear a full wig hairpiece. Rather, the wearer may only need to use a toupee that is positioned at the back, top, and/or front of the wearer's scalp. Under these circumstances, there is a substantial distance between the lower periphery of the hairpiece and the hearing aid of the wearer. To span this distance, one or more wires, cords, strings, straps, bands, or the like, can be attached to the hairpiece at or nears its lower periphery edge. An opposing end of the wires, cords, strings, straps, bands, or the like is then directed toward and are removably or fixedly secured to the hearing aid. The wearer's real hair can then be combed and/or brushed to cover and obscure the location of the spanning and adjacent wires, cords, strings, straps, bands, or the like.

The general purposes of this invention should be easily understood from reviewing the foregoing description and example. In the marketplace, however, only a small number of persons actually use both a hairpiece and one or more hearing aids. Consequently, there still is a need to provide similar hairpiece holding structures for persons that do not use hearing aids. Furthermore, if possible, it is desirable that the auditory canals not be obstructed.

Within the preferred embodiment of this invention, the ear engaging means does not generally obstruct the auditory canal of the wearer. In essence, the hearing aid is replaced with what is termed herein as ear engaging means. In fact, the hearing aid is considered to be one form of ear engaging means. Basically, the ear engaging means comprises one or more prostheses that are inserted into and/or engage the wearer's ear or ears. By using such ear engaging means, there is no need for the scalp of the wearer to be pierced or for an adhesive to be used.

In essence or concept, the ear engaging means of this invention generally comprises two pieces of thin plastic or metal. One piece is placed adjacent to the outer portion of the ear. The other piece is placed behind the ear. The two pieces are connected at one or more locations in such a manner that the pieces may be pressed tightly toward each other with the upper and back portions of the ear sandwiched therebetween. When used, the front piece is pressed against the inside of the ear and the back piece provides an anchor for a string, wire or cord which is subsequently secured to either a harness or directly to the hairpiece.

Within the preferred embodiment of this invention, the prostheses or ear engaging means is not intended to engage or be inserted into the external auditory meatus or auditory canal of the wearer's ear, such as when a person wears a hearing aid. Rather, the preferred embodiment of this invention secures the hairpiece to the cartilage of the ears of the wearer, without piercing the scalp of the wearer, or obstructing the auditory canal of the ear. This task is accomplished by the prostheses or ear engaging means hooking onto and/or gripping the ledges, flanges, and/or cartilage of the ear that form the helix, lobule, antihelix, lower crux of the antihelix, and/or scaphoid fossa of the wearer's ear.

Within the preferred and following embodiments of this invention, the ear engaging means defines one or more prostheses that are formed to generally assume at least a portion of the shape of the auricle or pinna of the wearer's ear.

More particularly, the prostheses or ear engaging means is formed to generally assume the shape of the concha, lower crux of the antihelix, and/or triangular fossa of one or more of the wearer's ears. The prostheses may also assume the shape of the upper crux of the antihelix and scaphoid fossa, and/or the antihelix and helix of the wearer's ears.

Alternatively, the prosthesis or ear engaging means may be structured to hook into the intertragic notch of the ear, be urged against the back of the ear, against the back of the helix of the ear, or against the back of a triangular fossa of the ear, and then hook over the helix of the ear to terminate within the helix canal of the ear.

Irrespective of the particular shape that is selected, when the apparatus of this invention is worn, the ear engaging means effectively grips either the sidewalls of the auditory canal and/or the pinna or the auricle of the ear.

As shown within the drawings, the prosthesis or ear engaging means may generally comprise a clip that passes from the back of the ear closest to the scalp, over the top of the ear or around the edges of the ear, and down into the concha below the lower crux of the antihelix.

In other words, the prosthesis or ear engaging means may comprise a plastic attachment or clip, or be manufactured from thin metal wire or plastic being bent to accomplish the intent of this invention.

Within the preferred embodiment of this invention, the ear engaging means has a front panel, a rear panel, and at least one membrane connecting the front panel to the rear panel. The membrane urges at least a portion of the front panel toward at least a portion of the rear panel, thereby, gripping the ear when the apparatus is worn.

For example, the front panel may be formed or molded to generally fit against the concha, cymba of concha, antihelix, or lower crux or crura of the antihelix of the ear.

Similarly, the rear panel may be formed or molded to generally fit against the back of the ear, back of the helix of the ear, or back of the triangular fossa of the ear.

Within one of the alternative embodiments of this invention, the membrane passes over the helix or helicis major of the ear between the front panel to the rear panel.

Furthermore, the front panel may be pivotally and/or rotatably attached or secured to the membrane. Alternatively, the rear panel may be pivotally and/or rotatably attached or secured to the membrane. In either case, the front panel is attached or secured to the rear panel by the membrane. The membrane itself may be rotatably secured to either or both the front panel and/or the rear panel.

During use, the prostheses or ear engaging means are inserted into, hooked onto, or clipped onto the wearer's ears. The hairpiece can then be secured, attached, or connected directly to the prostheses or ear engaging means.

As stated above, the apparatus of this invention also includes means for securing the ear engaging means to the hairpiece. Such securing means may be attached to or formed integrally with the ear engaging means.

For example, the hairpiece may be secured, attached or connected to the prostheses or ear engaging means by means of using one or more straps, cords, lines, cables, strings, bands, thread, wire, elastic cord, or the like, that combine together to form a harness. The harness secures the prostheses or ear engaging means to the hairpiece.

During use, the ear engaging means is inserted or attached to the ear of the wearer. Then the hairpiece is secured to the harness and the harness is placed about the wearer's head. Lastly, the harness is secured to the ear engaging means.

To accomplish these tasks, the securing means may include one or more holes placed within the ear engaging means through which the length of strap, cord, line, cable, string, band, thread, wire, elastic cord, or the like, may be passed and secured. Such hole may be placed within either the front panel, the rear panel, or the membrane.

More particularly, within the preferred embodiment of this invention, a first thin wire, string, cord or band is secured to the prostheses near the uppermost portions thereof. A hairpiece is then secured to the terminal end of the first thin wire. The first thin wire generally defines a tension strap for the hairpiece.

Alternatively, the first thin wire may span the entire distance over the scalp of the wearer from ear to ear. The hairpiece may be positioned either underneath or on top of the first thin wire.

A first portion of the first thin wire is secured to the uppermost portion of the prosthesis for the left ear. Similarly, a second portion of the first thin wire is secured to the uppermost portion of the prosthesis for the right ear.

The first and second portions of the first thin wire are joined or snapped together in an adjustable manner by use of an attachment means similar to that used at the back of an adjustable baseball cap.

A second thin wire, string, cord or band is also secured to the prostheses. However, attachment of the second thin wire should be positioned near the rearward most portions of the prostheses. The hairpiece is then secured to the terminal end of the second thin wire.

Alternatively, the second thin wire may span the entire distance behind the head of the wearer from ear to ear. The hairpiece may be positioned either underneath or on top of the second thin wire.

The securing means may further comprise means for adjusting the length or size of the thread, string, wire, or elastic cord. For example, the adjusting means may include an adjustable hook and loop fastening system, such as that sold under the trademark VELCRO. Other adjusting means may include: an adjustable strap, a generally elastic or stretchable material or member, telescoping members that are held in position by either mechanical means or by a frictional fit, and the similar structures that accomplish the same general purpose.

The securing means may also comprise or include a portion of mesh material that has openings therein through which the natural hair of the wearer may be pulled and/or inserted.

Within the preferred embodiment of this invention, the mesh, pad, or screen material is secured to approximately the midpoint of the second thin wire which spans across the back of the head of the wearer. The pad is intended to distribute the forces exerted between the second thin wire and the back of the head of the wearer, thus avoiding chaffing and cutting of the skin.

It is preferred that the pad generally comprise a length of approximately two to three inches (2"–3") or longer of strong, perforated plastic, rubber, or flexible, elastic material. It is the inventor's intention that hair from the hairpiece could be pulled through the perforations positioned within the pad to thereby cover the pad and make it inconspicuous.

If the hairpiece is positioned underneath the first and/or second thin wire, the hair of the hairpiece may be combed or brushed thereover to cover the wire.

If the hairpiece is positioned on top of the first and/or second thin wire, means for securing the hairpiece to the first and/or second thin wire may be provided. Alternatively, the first and/or second thin wire may be woven into or inserted into the hairpiece.

Thus structured, the apparatus of the current invention eliminates the need to use invasive surgery or piercing of the scalp in order to secure the hairpiece to the wearer.

Another embodiment of this invention, although not preferred, is to pierce the wearer's ear and attach an ear ring therethrough. In essence, the ear ring functions as the ear engaging means to which the securing means or adjustable strap, cord, line, cable, string, band, thread, wire, elastic cord, or the like, may be secured.

In addition to having the foregoing advantages, and other advantages described further below, the current invention also overcomes all of the previously mentioned disadvantages.

The preferred and several alternative embodiments of the apparatus and associated structures of the current invention, and the processes for manufacture and use thereof, are further described in greater detail in the following description, claims, and drawings of this Specification. However, to avoid any possible confusion as to the scope of the current invention, each of the following sections, claim language, and the drawings of this Specification in their entirety are incorporated herein by this reference.

The foregoing and other objectives and advantages of the current invention will become more readily apparent upon reading the following disclosure and referring to the attached drawings.

Figure 1:
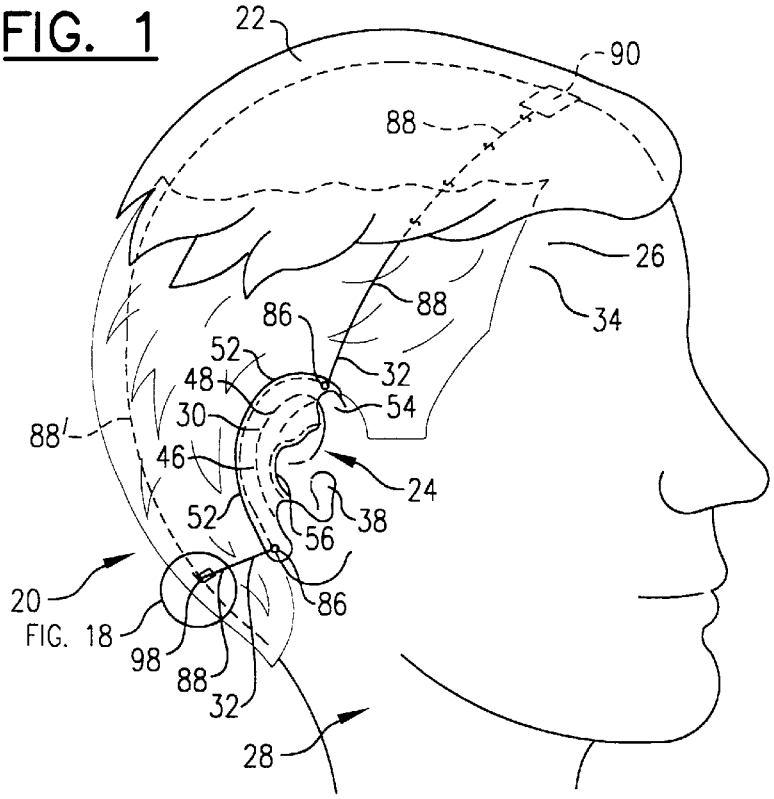
FIG. 1 is a schematic, right side, elevational view of a first embodiment of the current invention made in accordance with the teachings of this disclosure.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the current invention or which render other details difficult to perceive.

BEST MODE FOR CARRYING OUT THE INVENTION

Referring to the attached drawings, wherein like numerals indicate like parts, the present invention generally comprises an apparatus 20 for attaching a hairpiece 22 to an ear 24 and head 26 of a wearer 28.

The apparatus 20 generally comprises a combination of: (a) means 30 for engaging the ear 24 of the wearer 28, and (b) means 32 for securing the ear engaging means 30 to the hairpiece 22.

In essence, the ear engaging means 30 defines a form of prosthesis that is attached to the ear 24 of the wearer 28. More particularly, the ear engaging means 30 selectively and removably grips at least a portion of the ear 24 without requiring a scalp 34 of the wearer 28 to be pierced or an adhesive to be used when the apparatus 20 is worn.

The ear engaging means 30 may comprise a conventional or modified hearing aid 36 that is inserted into an auditory canal 38 of the ear 24.

Within a different embodiment of this invention, the ear engaging means 30 may comprise one or more conventional or modified ear rings 40 that are secured to the ear 24. The ear rings 40 may be mechanically clipped to the ear 24. Alternatively, the ear 24 may be pierced with one or more small holes 42 and a pierced ear ring 44 may be passed through the corresponding hole 42.

If the pierced ear rings 44 are used, the front panel 48 and/or the rear panel 50 may comprise small generally flat members that have a post thereon which is passed through the holes 42, whereupon the terminal end of the post is captured by a mated receiving member found either within the front panel 48 or the rear panel 50. Furthermore, the frictional fit or mechanical connection between the post and the receiving member should be such that there will be no or minimal danger that the ear 24 of the wearer 28 will be torn if the hairpiece is accidentally caught on an object. Rather, the post would simply be pulled away from the receiving member.

Figure 12:
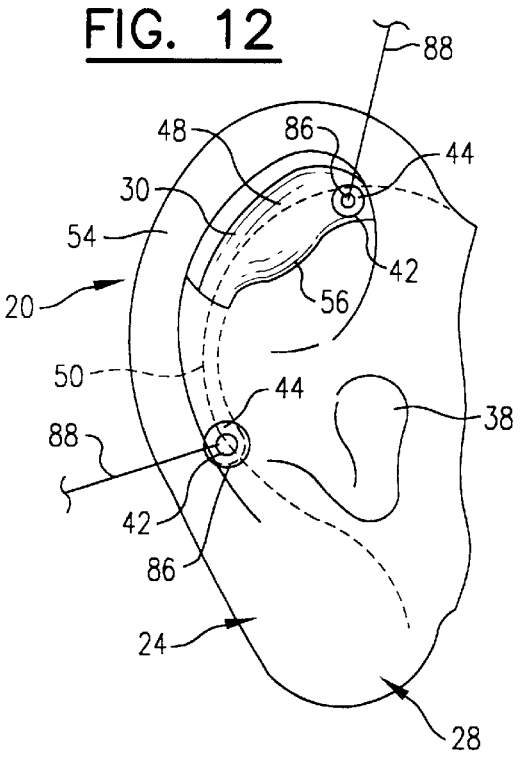
FIG. 12 is a schematic, enlarged, right side, elevational view of a sixth embodiment of this invention.
Figure 14:
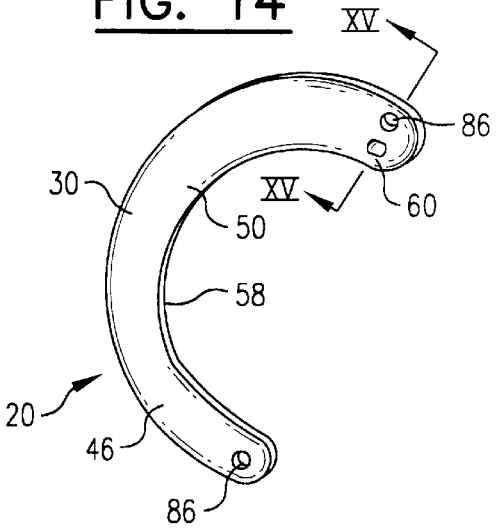
FIG. 14 is an enlarged, partial, right side, elevational view of the rear panel of the ear engaging means of the fifth embodiment shown in FIGS. 9, 10 and 11.

FIG. 12 illustrates the use of a pierced ear ring 44. Please note, however, that the-front panel 48 is enlarged and formed or molded to fit snugly against the ear 24.

Within the preferred embodiment of this invention, the ear engaging means 30 generally comprises a clip 46. The clip 46 has a front panel 48, a rear panel 50, and at least one membrane 52 that connects the front panel 48 to the rear panel 50. In essence, the clip 46 grips a pinna or an auricle 54 of the ear 24 between the front panel 48 and rear panel 50. The rear panel 50 has a general sickle shape the generally conforms to the rear or back portion of the ear 24.

The membrane 52 urges a lower portion 56 of the front panel 48 toward a lower portion 58 of the rear panel 50 to grip the ear 24 when the apparatus 20 is worn.

The membrane 52 simply comprises a bridge of material that spans between the front panel 48 and the rear panel 50.

As shown in FIGS. 1, 2, 3, 4, 5, 6, 7 and 13, the membrane 52 may be formed integrally with the front panel 48 and the rear panel 50.

Alternatively, as shown within FIGS. 8, 9, 10 and 11, the membrane 52 may comprise one or more separate elements that are mechanically and/or adhesively secured to the front panel 48 and to the rear panel 50.

Figure 9:
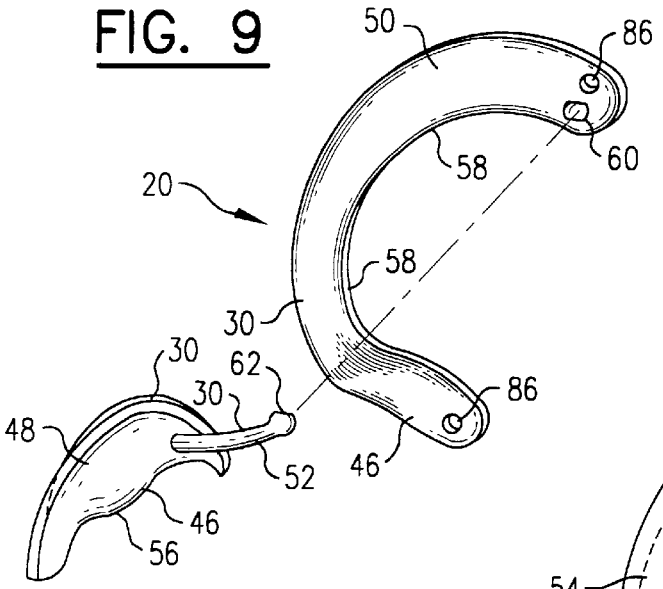
FIG. 9 is an enlarged, exploded, perspective view of a fifth embodiment of this invention, wherein the ear engaging means includes a front panel and a rear panel. The front panel is pivotally or rotatably secured to the rear panel via a rotatable membrane.
Figure 10:
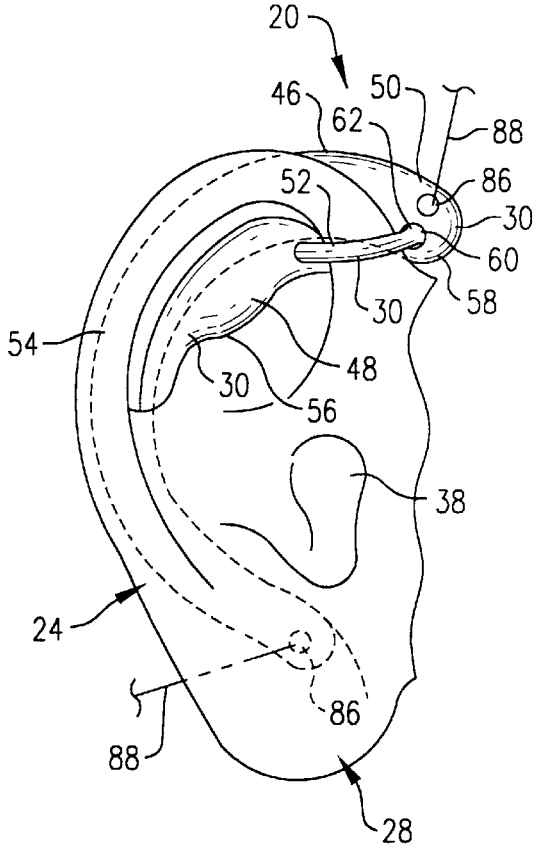
FIG. 10 is a schematic, enlarged, right side, elevational view of the fifth embodiment of this invention.
Figure 11:
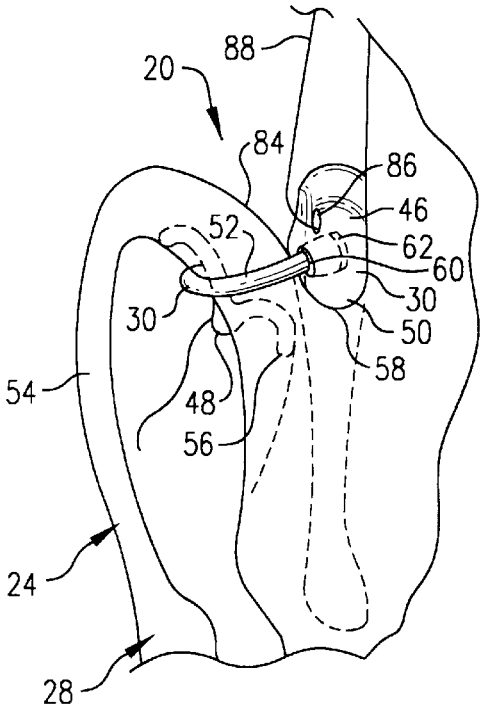
FIG. 11 is a schematic, enlarged, front, elevational view of the fifth embodiment of this invention.

Shown within FIGS. 9, 10 and 11, the membrane 52 may comprise an element that is pivotally and/or rotatably attached to the rear panel 50. Similarly, the membrane 52 may comprise an element that is pivotally and/or rotatably attached to the front panel 48. In either case, the front panel 48 is secured to the rear panel 50 by the membrane 52.

FIGS. 9, 10, 11, 14, 15 and 16 illustrate the rear panel 50 having a keyway or socket 60, receiving hole, or indentation into which a key or ball 62 of the membrane 52 is pressed, seated, and held in a slotted, rotatable or journaled fashion. In essence the key or ball 62 is operably secured to the rear panel 50 within the socket 60 using a snap-fit ball and socket connection. The material of the rear panel 50 that forms the keyway or socket 60 should have sufficient elastic properties to enable the key or ball 62 to be press-fitted therein and retained thereby.

The frictional forces or fit between the key or ball 62 and the sidewalls of the keyway or socket 60, however, should be sufficiently weak to permit the front panel 80 and membrane 52 to be pivoted forward out of tight engagement with the ear 24 to an inoperative position, thereby permitting the apparatus 20 to be removed from the ear 24.

Conversely, the frictional forces or fit between the key or ball 62 and the sidewalls of the keyway or socket 60 should be sufficiently strong to retain the front panel 48 and membrane 52 in an operative, relatively tight position with the rear panel 50, when the front panel 48 is pivoted rearwardly to engage the ear 24, thereby holding and retaining the apparatus 20 on the ear 24.

Within the preferred and many alternative embodiments of this invention, the front panel 48 and/or the rear panel 50 are generally formed and/or molded to fit the contours of the wearer's 28 ear 24. For example, the front panel 48 may be formed and/or molded to be juxtaposed against and fit the contours of pinna or auricle 54.

Figure 7:
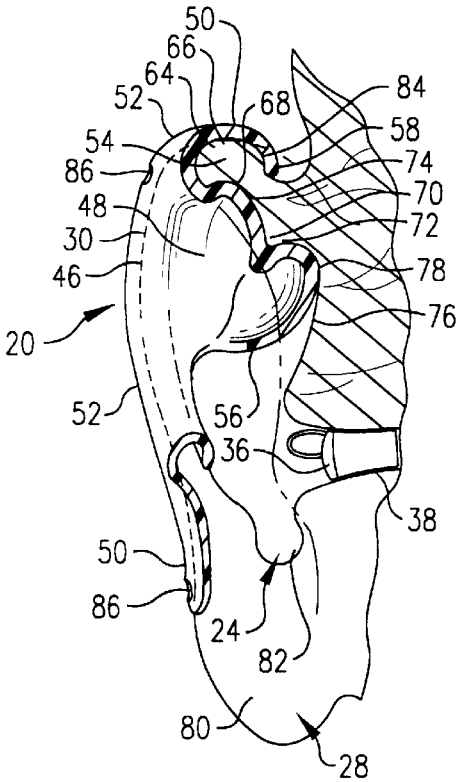
FIG. 7 is a schematic, enlarged, partial, cross-sectional, front, elevational view of the ear engaging means shown within FIG. 6 as used within the first embodiment of this invention, as seen along a plane defined by line VII—VII in FIG. 5.
Figure 8:
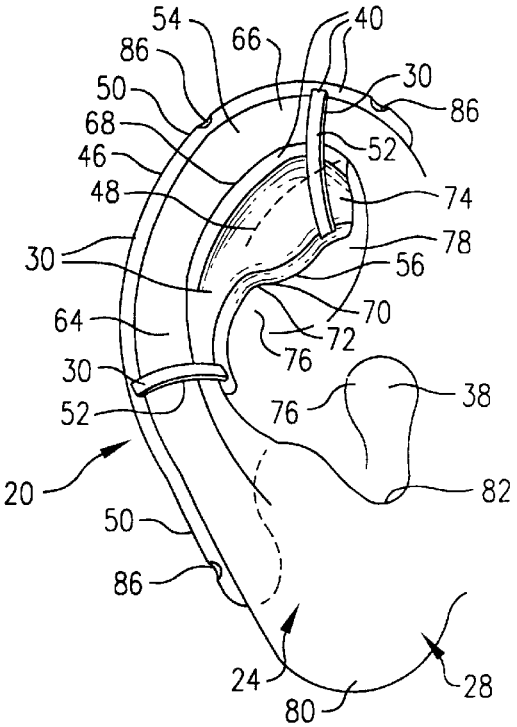
FIG. 8 is a schematic, enlarged, right side, elevational view of a fourth embodiment of this invention.
Figure 13:
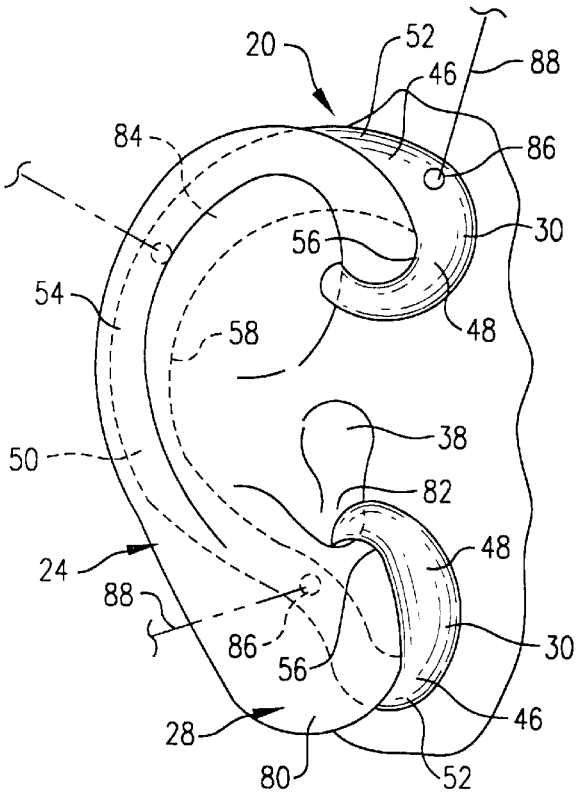
FIG. 13 is a schematic, enlarged, right side, elevational view of a seventh embodiment of this invention.

More particularly, as best shown in FIGS. 7 and 8, the front panel 48 may be formed and/or molded to generally assume the contours and shape of: helix 64; crus, crux or crura of helix 66; helix canal 68; antihelix 70; crus, crux or crura of antihelix 72; triangular or scaphoid fossa 74; concha 76; cymba of concha 78; and as seen in FIG. 13, lobule 80, and intertragic notch 82 of the ear 24. When the apparatus 20 is worn, the front panel 48 is urged toward and juxtaposed against the ear such that there is a comfortable but relatively tight fit between the apparatus 20 and the ear 24.

An important reason for using a form-fitted front panel 48 is that the flanged contour of the front panel 48 engages the ledges, flanges and/or cartilage structure of the ear 24. In essence, such cartilage structure is something that can be pulled against to retain the hairpiece 22 in position. The gripping or engagement of the flanged contour of the front panel 48 with the ledges, flanges and/or cartilage structure of the ear 24 is best seen within FIG. 7. Even if the pierced ear rings 44 shown in FIG. 12 were not used, the form-fitted front panel 48 would still have enough flanged structure therein to grip the ledges, flanges and/or cartilage structure of the ear 24 sufficiently to hold the hairpiece 22 in place. This is true even if the apparatus 20 does not even have a rear panel 50 or a membrane 52.

FIG. 10 illustrates the membrane 52 passing over the helix 64 or helicis major of the ear 24 between the front panel 48 to the rear panel 50.

Figure 15:
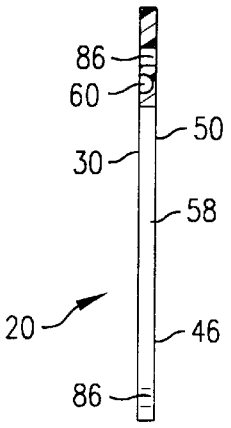
FIG. 15 is an enlarged, partial, cross-sectional, front, elevational view of the rear panel of the ear engaging means of the fifth embodiment shown in FIGS. 9, 10, 11 and 14, as seen along a plane defined by line XV—XV in FIG. 14.
Figure 16:
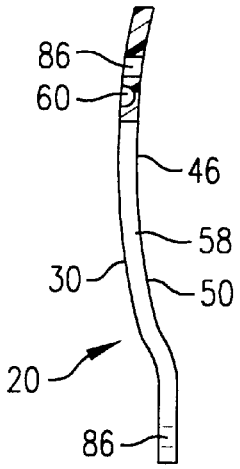
FIG. 16 is an enlarged, partial, cross-sectional, front, elevational view of an alternative rear panel for the ear engaging means of the fifth embodiment shown in FIGS. 9, 10, 11 and 14, as would be seen along a plane defined by line XV—XV in FIG. 14.

As best seen in FIGS. 3, 5, 6, 7, 9 and 16, the rear panel 50 may similarly be formed and/or molded to generally assume the contours and shape of a back 84 of the ear 24, such as along the back of the helix 64 and back of the triangular fossa 74. FIG. 15 illustrates a generally flat rear panel 50 which is not formed or molded to the contours of the ear 24. FIG. 16 illustrates a formed or molded rear panel 50 that may be used to fit the contours of the back 84 of the ear 24.

Within an alternative embodiment of this invention, as illustrated in FIG. 13, the prosthesis or ear engaging means 30 is structured to hook around the front of the ear 24 from the helix canal 68 positioned near the triangular fossa 74, over the crus of helix 66, be urged against the back 84 of the ear 24 behind the helix 64 and triangular fossa 74, pass around or under the lobule 80, and then hook into the intertragic notch 82.

Irrespective of the particular shape that is selected, when the apparatus 20 of this invention is worn, the ear engaging means 30 effectively grips either the sidewalls of the auditory canal 38 and/or the pinna or auricle 54 of the ear 24. Within the preferred embodiment of this invention, however, the auditory canal 38 is not blocked or obstructed.

As mentioned above, the apparatus 20 of this invention is also provided with means 32 for securing the ear engaging means 30 to the hairpiece 22. The securing means 32 may be attached to or formed integrally with the ear engaging means 30.

Figure 4:
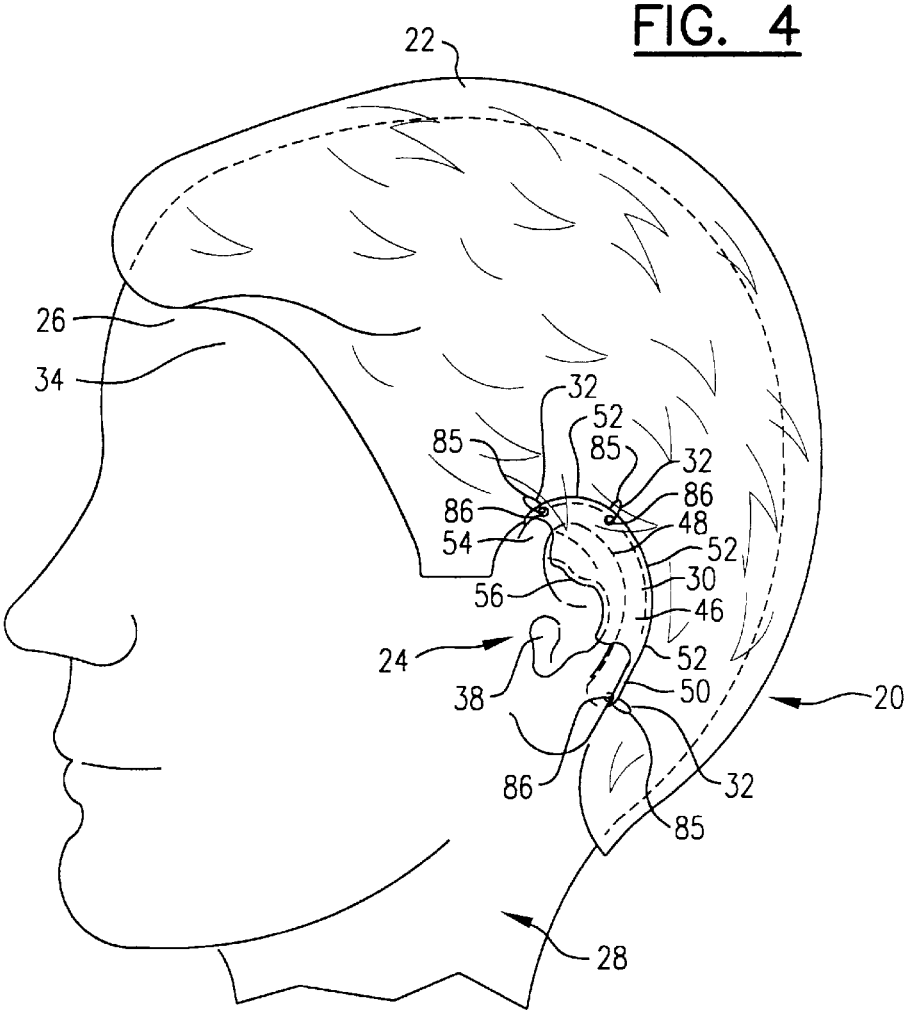
FIG. 4 is a schematic, left side, elevational view of a third embodiment of this invention. The ear engaging means of the second and third embodiments of this invention are generally identical. However, the means for securing the ear engaging means to the hairpiece is different. More particularly, the first and second embodiments of this invention are intended to be used when wearing a toupee-style hairpiece. The third embodiment of this invention, however, is intended to be used when wearing a full-sized, wig-style hairpiece.
Figure 5:
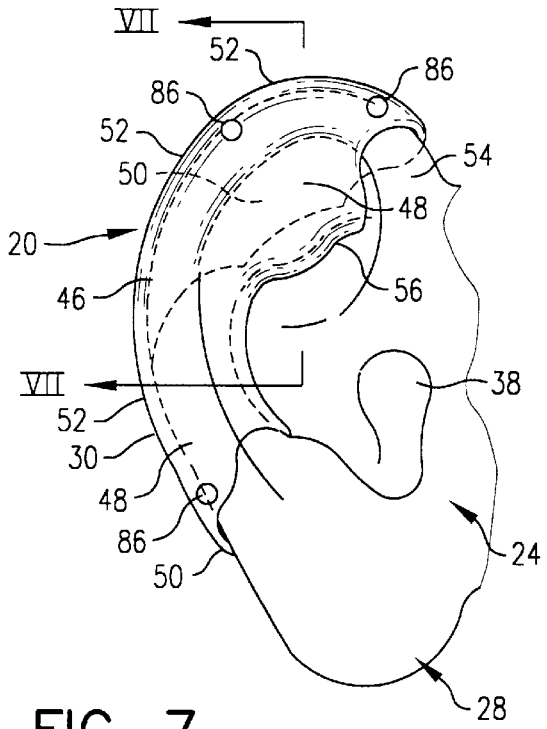
FIG. 5 is a schematic, enlarged, right side, elevational view of the ear engaging means as generally used within the first embodiment of this invention.
Figure 6:
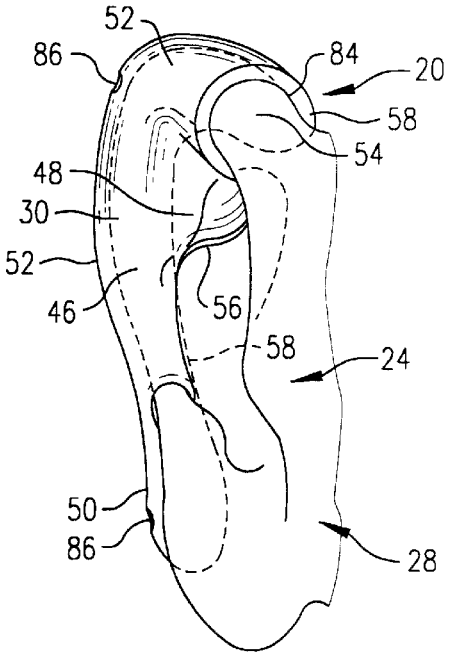
FIG. 6 is a schematic, enlarged, front, elevational view of the ear engaging means as used within the second and third embodiments of this invention.

As illustrated within FIG. 4, the securing means 32 may simply comprise a snap, clip, tie 85, loop, or other means for hooking or securing the perimeter or edges of the hairpiece 22 to the apparatus 20.

Alternatively, the securing means 32 may include one or more holes 86 through which one or more lengths of thread, string, wire, elastic cord 88, or the like, may be passed and/or secured. The hole or holes 86 may be positioned within the front panel 48, within the rear panel 50, and/or within the membrane 52.

Figure 2:
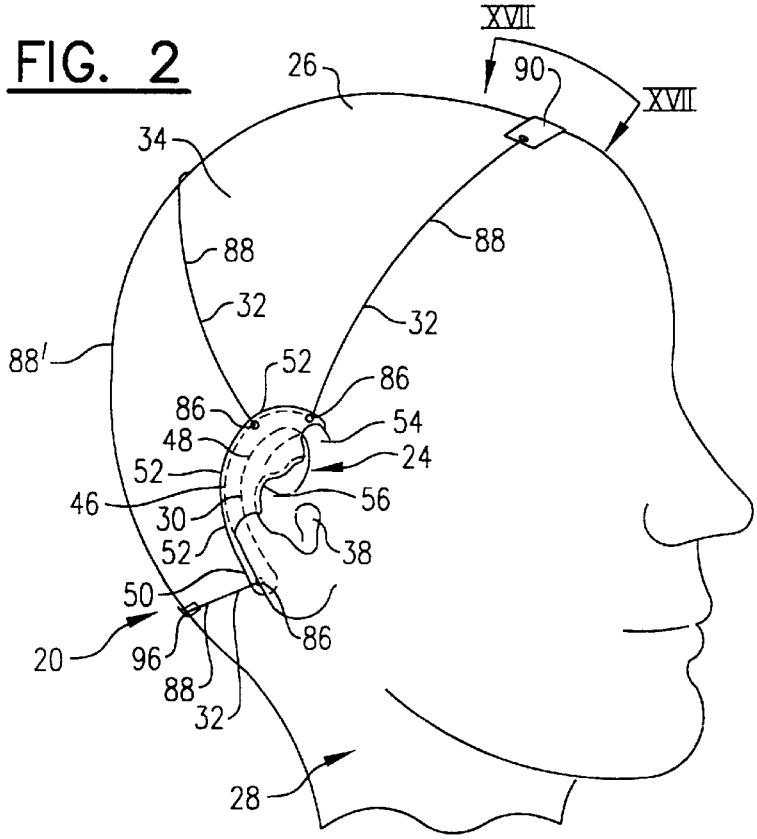
FIG. 2 is a schematic, right side, elevational view of a second embodiment of this invention. The second embodiment of this invention is illustrated within FIG. 2 without the invention being obstructed or obscured by the inclusion of either a hairpiece or natural hair of the wearer.
Figure 3:
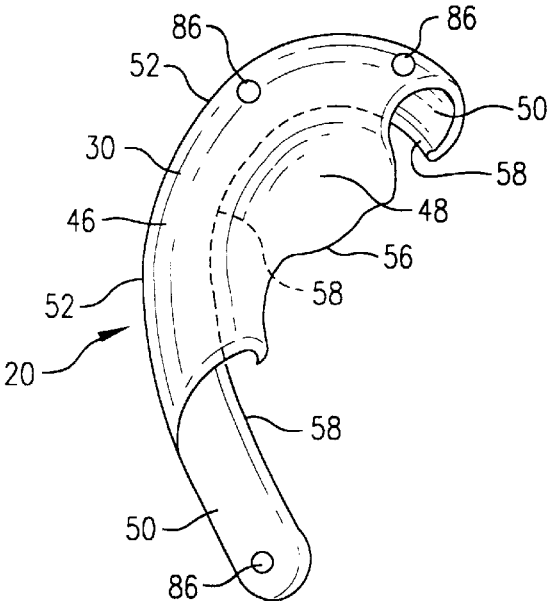
FIG. 3 is an enlarged, right side, elevational view of the ear engaging means as used within the second embodiment of this invention.
Figure 17:
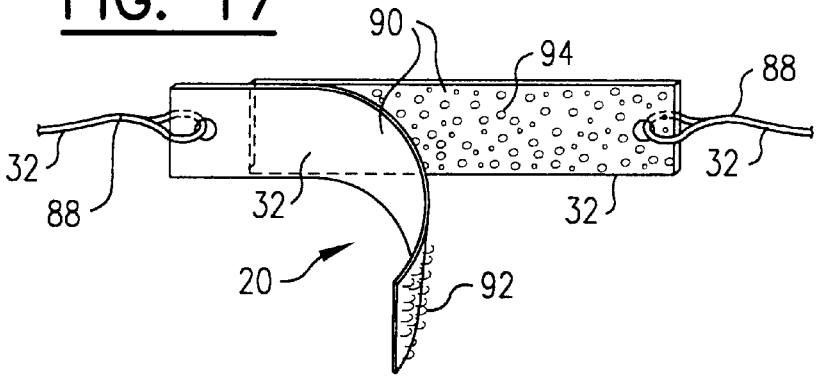
FIG. 17 is an enlarged, perspective view of the securing means further including means for adjusting a length and/or size of a thread, string, wire, elastic cord, or the like. The adjusting means is preferably used within the first and second embodiments of this invention as seen along a plane defined by line XVII—XVII in FIG. 2. More particularly, such adjusting means includes an adjustable hook and loop fastening system, such as that sold under the trademark VELCRO.
Figure 18:
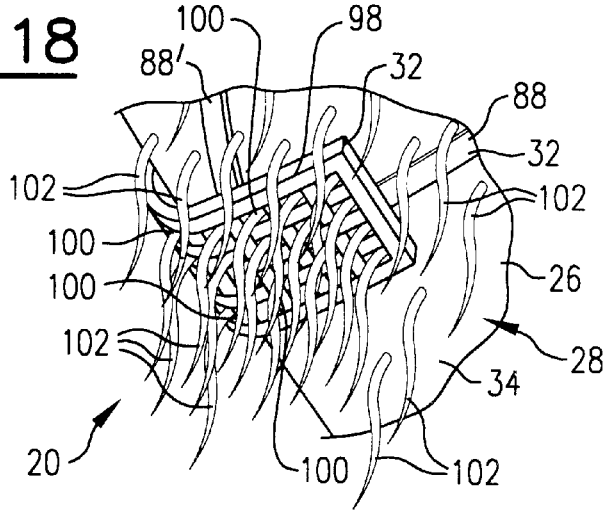
FIG. 18 is a schematic, perspective view of the securing means further including a portion of mesh material having openings therein through which at least a portion of the natural hair of the wearer may be pulled or inserted. Use of such mesh material is shown within FIGS. 1 and 2.

Within the preferred embodiment of this invention, the securing means 32 also includes means 90 for adjusting the length or size of the thread, string, wire, elastic cord 88, or the like. For example, as shown in FIGS. 1, 2, and 17, the adjusting means 90 may generally comprise an adjustable hook and loop fastening system commonly sold under the trademark VELCRO. FIG. 17 illustrates the adjusting means 90 as having a hooked portion 92 and a looped portion 94.

Alternative structures that accomplish these same objectives could also be used. For example, the adjusting means 90 may comprise a cord 88 whose length can be shortened or adjusted. As shown in FIG. 2, the adjusting means 90 may comprise a strap or segment of generally elastic material 96. The adjusting means 90 could also comprise a pair of mated segments of plastic, similar to the band of a sports cap, to adjust the length or girth thereof. Other structures could similarly be used as the adjustment means 90.

One of the problems with wearing a hairpiece 22 is keeping the hairpiece 22 in place. If one or more cords 88 are used to harness and hold onto the hairpiece 22, it is preferable to assure that the placement of the cord or cords 88 is maintained. Consequently, as illustrated within FIG. 1, the inventor prefers that the securing means 32 also include a portion of mesh material 98 that has openings 100 therein through which natural hair 102 of the wearer 28 may be pulled and/or inserted.

Furthermore, to prevent the hairpiece 22 from slipping forward onto the brow of the wearer 28, one or more lengths of thread, string, wire, elastic cord 88', or the like, may be secured to and placed to span between the mesh material 98 and the hairpiece 22.

Figure 19:
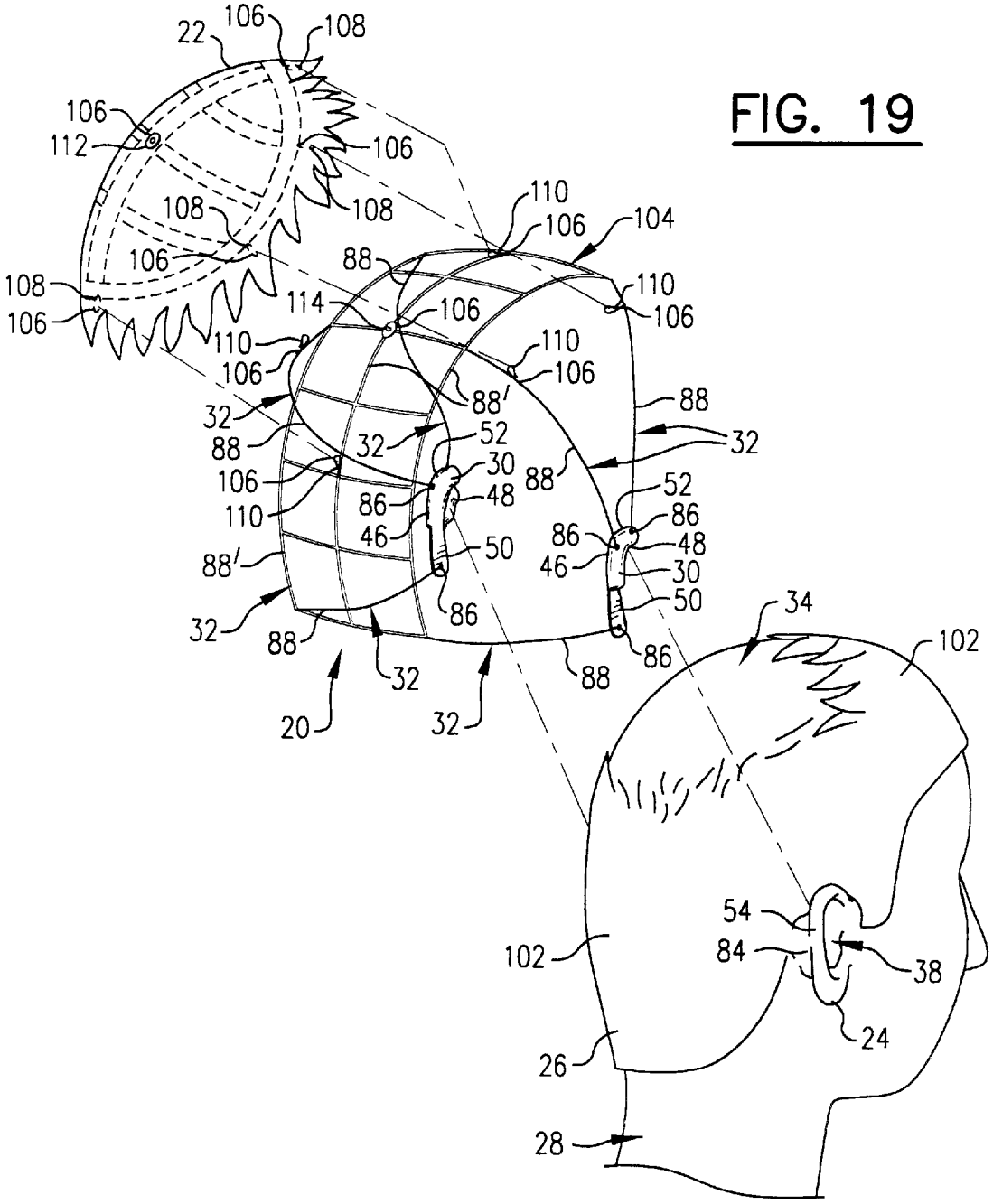
FIG. 19 is an exploded, schematic, perspective view of an alterative securing means having a harness that, when worn, is generally covered by the natural hair of the wearer.

As shown within FIG. 19, the securing means 32 may further comprise a harness 104 of mesh material. The harness 104 is attached or secured to the ear engaging means 30 by one or more cords 88. The harness 104 is preferably manufactured of a plastic material that generally maintains its overall shape, but is flexible enough to bend or mold generally to the contour of the head 26 of the wearer 28 when the apparatus 20 is worn. When the apparatus 20 is worn, the harness 104 is generally covered by the natural hair 102 of the wearer 28. The covering of the harness 104 and cords 88 can be quickly and easily accomplished by simply brushing the natural hair 102 of the wearer 28 in such a manner that the harness 104 and cords 88 fall toward the scalp 34 of the wearer 28 and only the natural hair 102 is seen. Thus positioned, the harness 104 provides significant additional stabilization and securement for the apparatus 20, and prevents the apparatus 20 from sliding forward, backward, to the side, and/or rotating upon the head 26 of the wearer 28.

If desired, the cords 88 may also be formed to assume a meshed pattern or form, therefore, extending the mesh or harness 104 further toward the ear 24.

The apparatus 20 may also be provided with means 106 for securing the hairpiece 22 to the harness 104. For example, such hairpiece securing means 106 may comprise detachable and attachable matched or mated hooks, loops, snaps, buttons and button holes, VELCRO attachment devices, and similar structures. For example, within FIG. 19, the hairpiece securing means 106 generally comprises hooks 108 that operatively engage loops 110 placed or formed within the harness 104. In addition thereto, FIG. 19 illustrates the hairpiece securing means 106 further including a snap mechanism 112 secured to the hairpiece 22 and another snap mechanism 114 secured to the harness 104. Of course, snap mechanism 112 and snap mechanism 114 can operatively engage one another.

It is also preferred that the various elements of the apparatus 20 be manufactured of material that would have a flesh-like tone or color to further hide their appearance from view.

The means and construction disclosed herein are by way of example and comprise primarily the preferred and several alternative forms of putting the invention into effect. Although the drawings depict the preferred and several alternative embodiments of the invention, other embodiments are described within the preceding and following text.

One skilled in the art will appreciate that the disclosed apparatus and devices may have a wide variety of different designs, shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its various forms, including all alternatives, modifications, equivalents, and alternative embodiments that fall within the legitimate and valid scope of the appended Claims, appropriately interpreted under the Doctrine Of Equivalents.

INDUSTRIAL APPLICABILITY

The apparatus and methods taught herein enable persons suffering from hair loss or hair thinning to quickly, efficiently, effectively, and safely fasten and/or attach a hairpiece to one or more of their ears and thereby to their head, without requiring the application of adhesive strips to their scalp or requiring the wearer to undergo painful surgery.

A specially custom or form-fitted apparatus or a more generally fitted apparatus or appliance could be manufactured and distributed. Consequently, this invention could be manufactured and distributed by medical doctors, plastic surgeons, special medical clinics, hospitals and the like.

Alternatively, if mass produced, the apparatus of this invention could be commercially distributed. Thus manufactured, this invention could be readily purchased at nearly every department store, drug store, and the like, throughout the country and abroad. More particularly, this invention could be sold within hospitals, clinics, nursing homes, pharmacies, drug stores, hair salons, wig shops, toupee shops, and nearly any small or large retail department store for general consumer use.

I claim:

1. An apparatus for attaching a hairpiece to a wearer without a need to use an adhesive, the wearer having a head, at least a portion of one ear and a scalp, the ear possibly having a pinna, an auricle, a concha, a cymba of concha, an antihelix, a lower crux of the antihelix, a crura of the antihelix, a helicis major, a helix, a helix canal, an intertragic notch, a back of the ear, a back of the helix of the ear, a back of a triangular fossa of the ear, said apparatus comprising a combination of:

(a) means for selectively and removably gripping and clipping the pinna or the auricle of the ear of the wearer without requiring the scalp of the wearer to be pierced or the adhesive to be used when said apparatus is worn, said ear engaging means further comprises a clip having a front panel, a rear panel, and at least one membrane connecting said front panel to said rear panel; and (b) means for securing said ear engaging means to the hairpiece, said securing means being attached to or formed integrally with said ear engaging means.

2. The apparatus of claim 1, wherein said membrane urges a lower portion of said front panel towards a lower portion of said rear panel, thereby, gripping the ear when said apparatus is worn.

3. The apparatus of claim 1, wherein said front panel is formed or molded to generally fit against the concha, the cymba of concha, the antihelix, or the lower crux or the crura of the antihelix of the ear.

4. The apparatus of claim 3, wherein said rear panel is formed or molded to generally fit against the back of the ear, the back of the helix of the ear, or the back of the triangular fossa of the ear.

5. The apparatus of claim 4, wherein said securing means includes at least one hole through which a length of thread, string, wire, or elastic cord may be passed and secured.

6. An apparatus for attaching a hairpiece to a wearer without a need to use an adhesive, the wearer having a head, at least a portion of one ear and a scalp, the ear possibly having a pinna, an auricle, a concha, a cymba of concha, an antihelix, a lower crux of the antihelix, a crura of the antihelix, a helicis major, a helix, a helix canal, an intertragic notch, a back of the ear, a back of the helix of the ear, a back of a triangular fossa of the ear, said apparatus comprising a combination of:

(a) means for selectively and removably gripping and clipping the pinna or the auricle of the ear of the wearer without requiring the scalp of the wearer to be pierced or the adhesive to be used when said apparatus is worn, said ear engaging means further comprising a clip having a front panel, a rear panel, and at least one membrane connecting said front panel to said rear panel and defining a means for passing over the helix or the helicis major of the ear between said front panel to said rear panel, said front panel being formed or molded to generally fit against the concha, the cymba of concha, the antihelix, or the lower crux or the crura of the antihelix of the ear, said rear panel being formed or molded to generally fit against the back of the ear, the back of the helix of the ear, or the back of the triangular fossa of the ear; and (b) means for securing said ear engaging means to the hairpiece, said securing means being attached to or formed integrally with said ear engaging means.

7. The apparatus of claim 6, wherein said front panel is pivotally or rotatably attached to said rear panel, said front panel being secured to said rear panel by said membrane.

8. The apparatus of claim 6, wherein said rear panel is pivotally or rotatably attached to said membrane, said front panel being secured to said rear panel by said membrane.

9. An apparatus for attaching a hairpiece to a wearer without a need to use an adhesive, the wearer having a head, at least a portion of one ear and a scalp, the wearer possibly having hair, the ear possibly having a pinna, an auricle, a concha, a cymba of concha, an antihelix, a lower crux of the antihelix, a crura of the antihelix, a helicis major, a helix, a helix canal, an intertragic notch, a back of the ear, a back of the helix of the ear, a back of a triangular fossa of the ear, said apparatus comprising a combination of:

(a) means for selectively and removably gripping and clipping the pinna or the auricle of the ear of the wearer without requiring the scalp of the wearer to be pierced or the adhesive to be used when said apparatus is worn, said ear engaging means further comprising a clip having a front panel, a rear panel, and at least one membrane connecting said front panel to said rear panel, said front panel being formed or molded to generally fit against the conchs the cymba of concha, the antihelix, or the lower crux or the crura of the antihelix of the ear, said rear panel being formed or molded to generally fit against the back of the ear, the back of the helix of the ear, or the back of the triangular fossa of the ear; and (b) means for securing said ear engaging means to the hairpiece, said securing means being attached to or formed integrally with said ear engaging means, said securing means including at least one hole through which a length of thread, string wire, or elastic cord may be passed and secured, said securing means further including a length of thread, string, wire, or elastic cord which is passed through said at least hole and secured to said front panel, to said rear panel, or to said membrane.

10. The apparatus of claim 9, wherein said securing means further comprises means for adjusting a length or size of said thread, string, wire, or elastic cord.

11. The apparatus of claim 10, wherein said securing means further includes a portion of mesh material having openings therein through which the hair of the wearer may be pulled or inserted.

12. The apparatus of claim 10, wherein said adjusting means includes an adjustable hook and loop fastening system.

13. The apparatus of claim 12, wherein said adjusting means is at least partially manufactured of a generally elastic material.

14. An apparatus for attaching a hairpiece to a wearer without a need to use an adhesive, the wearer having a head, at least a portion of one ear and a scalp, the ear possibly having a pinna, an auricle, a concha, a cymba of concha, an antihelix, a lower crux of the antihelix, a crura of the antihelix, a helicis major, a helix, a helix canal, an intertragic notch, a back of the ear, a back of the helix of the ear, a back of a triangular fossa of the ear, said apparatus comprising a combination of:

(a) means for selectively and removably gripping and clipping the pinna or the auricle of the ear of the wearer without requiring the scalp of the wearer to be pierced or the adhesive to be used when said apparatus is worn; and (b) means for securing said ear engaging means to the hairpiece, said securing means being attached to or formed integrally with said ear engaging means, wherein when used by the wearer said ear engaging means hooks into the intertragic notch of the ear, is urged against the back of the ear, the back of the helix of the ear, or the back of the triangular fossa of the ear, and hooks over the helix of the ear to terminate within the helix canal of the ear.

* * * * *

UNITED STATES PATENT AND TRADEMARK OFFICE

CERTIFICATE OF CORRECTION

PATENT NO. : 5,915,389

DATED : June 29, 1999

INVENTOR(S) : Gordon Tang

It is certified that error appears in the above-identified patent and that said Letters Patent is hereby corrected as shown below:

Column 10, line 49, delete "the-front" and insert -- the front --.
Column 15, line 40, delete "conchs" and insert -- concha, --.

Signed and Sealed this

Twentieth Day of June, 2000

*Attest:*

Q. TODD DICKINSON

*Attesting Officer*

*Director of Patents and Trademarks*